United States Patent [19]

Mandel

[11] Patent Number: 5,076,556

[45] Date of Patent: Dec. 31, 1991

[54] COMPACT, SINGLE FOLD PLATE, BI-ROLL FOLDER, WITH Z-FOLD CAPABILITY

[75] Inventor: Barry P. Mandel, Fairport, N.Y.

[73] Assignee: Xerox Corporation, Stamford, Conn.

[21] Appl. No.: 560,812

[22] Filed: Jul. 31, 1990

[51] Int. Cl.[5] ..... B42C 1/00

[52] U.S. Cl. ..... 270/45; 270/47; 493/421

[58] Field of Search ..... 270/32, 47, 45, 46; 493/419, 420, 421

[56] References Cited

U.S. PATENT DOCUMENTS

| | | | |
|---|---|---|---|
| 2,589,436 | 3/1952 | Rouan | 493/421 |
| 2,807,463 | 9/1957 | Smith | 493/421 |
| 3,804,399 | 4/1974 | Rupp . | |
| 4,455,081 | 6/1984 | Yoshimura et al. . | |
| 4,518,380 | 5/1985 | Shimizu et al. . | |
| 4,586,704 | 5/1986 | Lehmann et al. . | |
| 4,717,134 | 1/1988 | Iida et al. . | |
| 4,900,391 | 2/1990 | Mandel et al. | 270/45 |
| 4,905,977 | 3/1990 | Vijuk . | |

FOREIGN PATENT DOCUMENTS

| | | | |
|---|---|---|---|
| 232372 | 11/1985 | Japan | 270/45 |

*Primary Examiner*—Edward K. Look
*Assistant Examiner*—Therese M. Newholm
*Attorney, Agent, or Firm*—Oliff & Berridge

[57] ABSTRACT

A sheet folding apparatus is disclosed which includes an inlet for receiving a sheet material from outside of the sheet folding apparatus, an outlet for discharging the sheet material to outside of the sheet folding apparatus, and a folding mechanism within the apparatus for placing one or more folds in the sheet material. The folding mechanism includes a fold position controlling chamber having first and second ends and including at least one fold plate stop spaced from the first end for blocking the fold position controlling chamber, first and second fold producing rollers contacting each other at peripheral surfaces thereof and located adjacent the first end of the fold position controlling chamber for withdrawing a sheet from the fold position controlling chamber and placing a fold therein and a recirculation passage extending around the periphery of one of the first and second fold producing rollers so that a sheet can be conveyed around the outer periphery thereof and be inserted back into the fold position controlling chamber after being withdrawn from the fold position controlling chamber by the first and second fold producing rollers. The once-folded sheet can then be directed to the outlet or back through the first and second fold producing rollers to place a second fold therein. This structure permits one or more folds to be placed in sheet material while requiring only a single fold position controlling chamber and one pair of fold producing rollers.

19 Claims, 10 Drawing Sheets

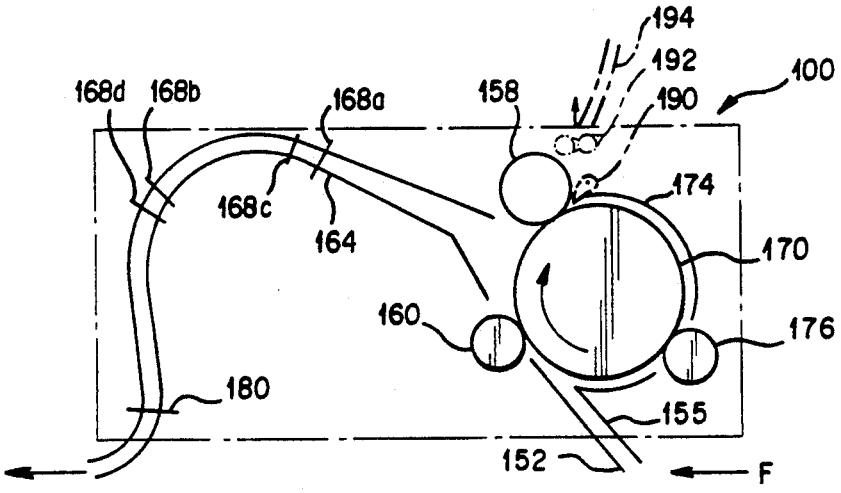
FIG. 9
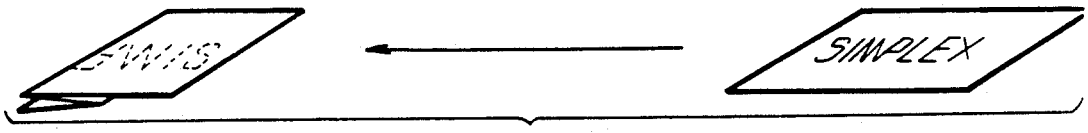
FIG. 10A
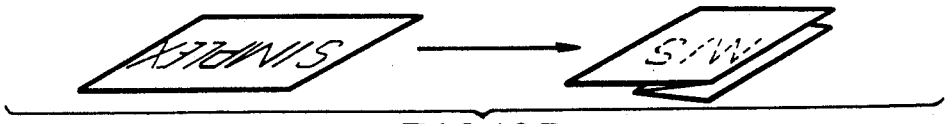
FIG. 10B
FIG. 11A
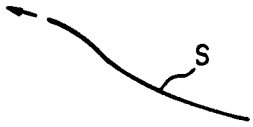
FIG. 11B
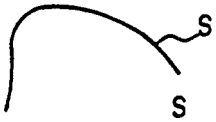
FIG. 11C
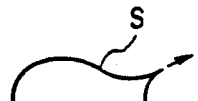
FIG. 11D
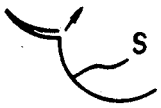
FIG. 11E
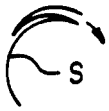
FIG. 11F
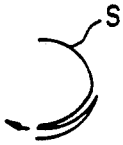
FIG. 11G
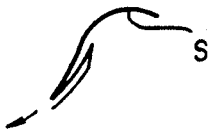
FIG. 11H

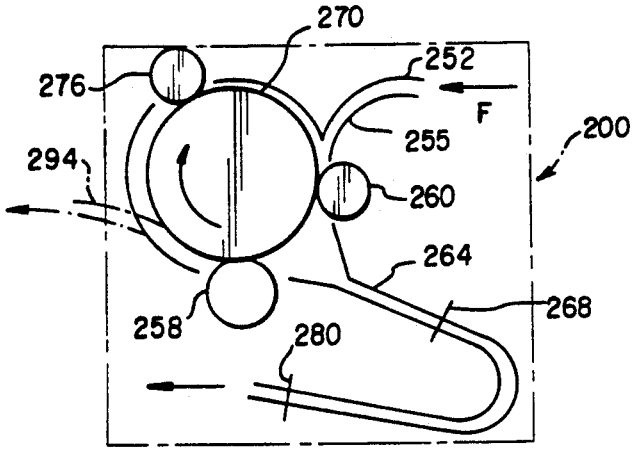
FIG. 12
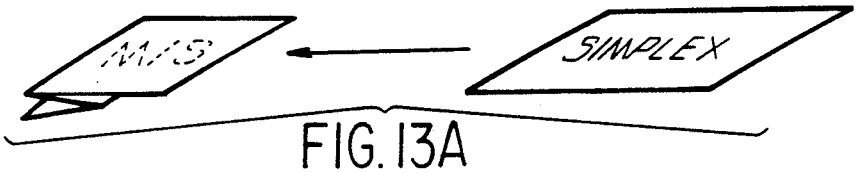
FIG. 13A
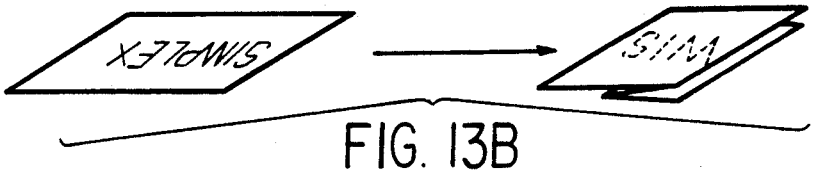
FIG. 13B
FIG. 14A
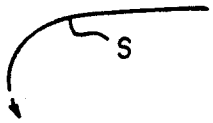
FIG. 14B
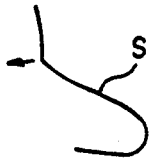
FIG. 14C
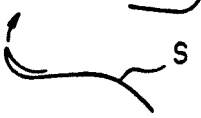
FIG. 14D
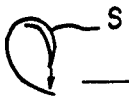
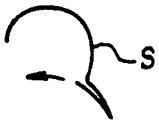
FIG. 14E
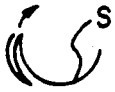
FIG. 14F
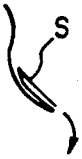
FIG. 14G
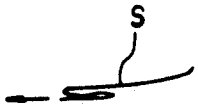
FIG. 14H

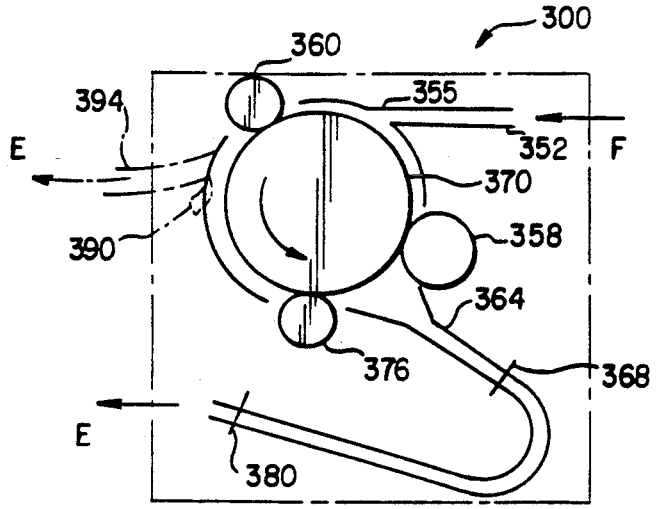
FIG. 15
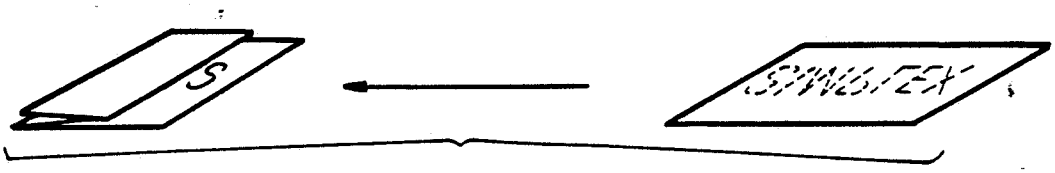
FIG. 16A
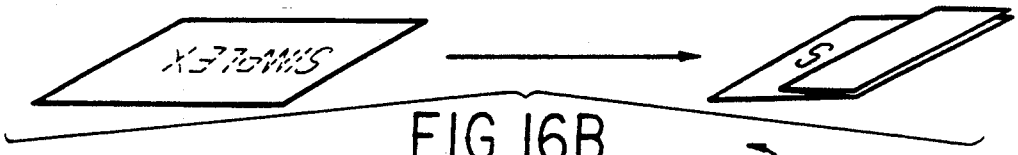
FIG. 16B
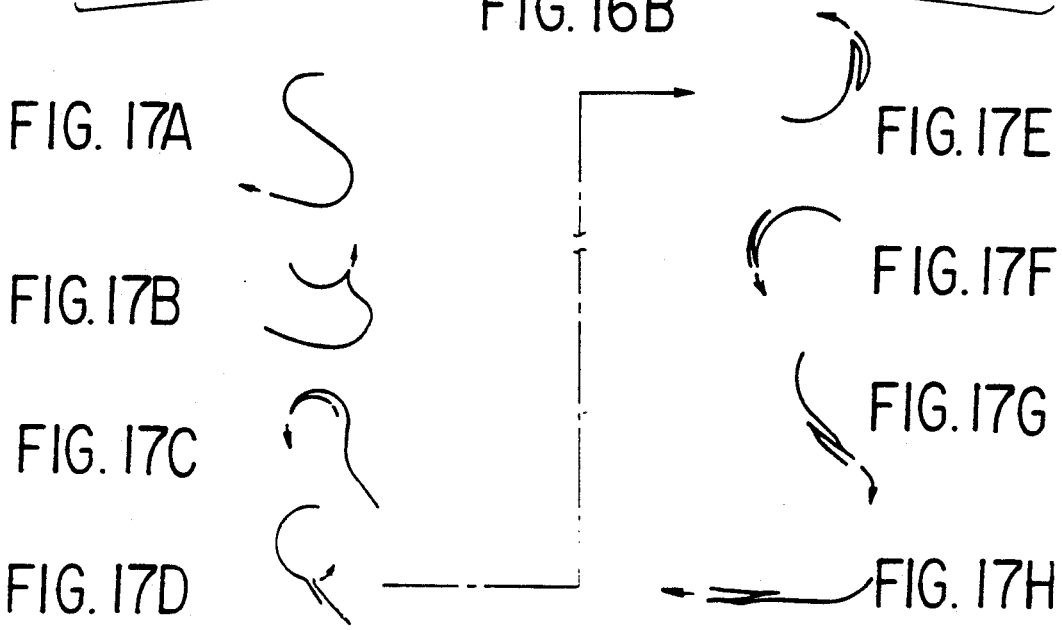

COMPACT, SINGLE FOLD PLATE, BI-ROLL FOLDER, WITH Z-FOLD CAPABILITY

BACKGROUND OF THE INVENTION

1. Field of the Invention

The present invention involves devices for folding sheets of paper, such as documents, and in particular to devices capable of producing two or more folds in a sheet of paper.

2. Description of Related Art

There are two primary methods of generating folds in paper. These are commonly called "buckle folding" and "knife folding". As shown in FIG. 1A, buckle folders function by driving a sheet of paper S with drive rollers 2,4 through a fold chamber 8 against a stop 10, and allowing a controlled buckle to form within an appropriately designed set of baffles. This buckle is drawn into a nip by a pair of fold rollers 4,6. These rollers usually contact the sheet along most of its width and have a high normal force to insure a tight fold. Knife folders, as shown in FIG. 1B, work by registering one or more sheets S adjacent a pair of fold rollers 4,6 by contacting an edge of the sheet S against a stop 10 and then deflecting the sheet(s) S into the fold nip using a moving "knife edged" bar 12 which is moved in the direction K as shown in FIG. 1B.

Knife folders have been commonly used to perform single folds on saddle stitched sets of paper, and buckle folders are often designed with two or more fold stations placed sequentially to perform more complex folds. Two commonly used complex folds include "letter folds", in which 8.5 × 11 inch or "letter" size sheets are folded twice as shown in FIG. 2A. These folders are often used in conjunction with direct mail systems which automatically insert the folded sheets into envelopes. A second common complex fold is called a "Z" fold and is usually performed on A3 or 17 inch size sheets (S″) to enable the insertion of these large sheets within a set of A4 or 8.5 × 11 inch size paper (S′). As shown in FIG. 2B, this type of fold makes the use and handling of large size sheets much simpler and practical by folding them so that their outer dimensions match those of standard letter size paper.

U.S. Pat. No. 4,717,134 to Iida et al. discloses a sheet folding apparatus including a plurality of sheet processing units each having a pair of folding rollers, a deflector and a fold position controlling chamber. The apparatus can produce two-fold, Z-fold and reverse Z-fold sheets. In a Z-fold mode, a sheet is guided by a first sheet deflector into a first fold chamber until stopped by a stopper A buckle is formed and gripped by a first roller couple to form a first fold therein. The sheet now having one fold is guided by a second deflector to a second fold chamber until stopped by a second stopper. Another buckle is formed and gripped by a second roller couple to form a second fold therein. The sheet is then guided by a third deflector to a third stage roller couple and transported through a third passage to an outlet.

FIG. 3 illustrates a Z-fold producing sheet folder similar to that disclosed in the above-referenced U.S. Pat. No. 4,717,134. A sheet traveling along feed path F is moved into folding apparatus 20 by a pair of rollers 22. A first deflector 24 either allows the sheet to bypass the folding apparatus and exit through rollers 26 or is actuated to deflect the sheet through passage 27 and into fold chamber 28. A plurality of stoppers, or gates, 30*a–d* are provided in fold chamber 28 and are selectively moved into fold chamber 28 to engage a lead edge of a sheet to control the location of a first fold to be formed in the sheet. Gates 30*a–d* are also selectively engaged depending on the size of the sheet being folded. Once the sheet is stopped by one of gates 30*a–d* a buckle is formed and captured in the nip between rollers 32,34 to form a first fold in the sheet. Deflector 36 either deflects the sheet so that it passes through rollers 34,38 and into passage 43 to exit through rollers 26, or is moved out of the path of the sheet so that the sheet can enter second fold chamber 40. Depending on the size of the sheet and the desired location of a second fold to be placed in the sheet, one of gates 42*a*,42*b* is moved into fold chamber 40 to stop the forward movement of the oncefolded sheet therein. A second buckle then forms in the sheet and is captured in the nip between rollers 34,38 to form a second fold in the sheet. The sheet is then conveyed through passage 43 to exit rollers 26 Thus, in order to form a Z-fold in a sheet of paper, two fold plates 28,40 and two sets of fold rollers 32,34 and 34,38 consisting of at least three rollers is required Additionally, a considerable amount of vertical space (about 27 inches) is required to contain the various passages and rollers of this prior art Z-folder.

U.S. Pat. No. 4,905,977 to Vijuk discloses a sheet folding apparatus which places Z-folds or letter folds in one or more sheets. This device includes a first stopper member for stopping the passage of one or more sheets along a paper path, a knife for forcing the stopped sheet through a slot and into a first pair of fold rollers, a second stopper for stopping the once-folded sheet(s) and a second pair of fold-forming rollers for placing a second fold in the sheets.

U.S. Pat. No. 4,900,391 to Mandel et al. discloses a recirculating folder for direct mail application. A two fold chamber, three fold roller arrangement similar to that described with reference to FIG. 3 is used to place a letter fold in one or more sheets. These sheets are then recirculated to a "wait station" where they are temporarily held and then inserted into an enveloping forming sheet which is then folded and glued to form an envelope filled with insert material which is "ready-to-mail".

U.S. Pat. No. 4,518,380 to Shimizu et al discloses a paper folding device capable of placing only a single fold in a sheet of paper.

U.S. Pat. No. 4,586,704 to Lehmann et al. discloses a folding machine for placing two folds in a sheet. The machine of Lehmann et al. includes two folding pockets and at least two pairs of folding cylinders to place two folds in a sheet of paper.

U.S. Pat. No. 4,455,081 to Yoshimura et al. discloses an apparatus for placing a single fold in sheets of paper.

U.S. Pat. No 3,804,399 to Rupp discloses a sheet folding apparatus which includes two fold plates and at least three fold rollers to form two folds in a sheet.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

OBJECTS AND SUMMARY OF THE INVENTION

It is an object of the present invention to provide an apparatus for placing one or more folds in a sheet of paper which is simple in construction and inexpensive to build.

It is another object of the present invention to provide an apparatus for placing two or more folds in a sheet of paper which includes fewer parts than previous folding apparatus.

It is another object of the present invention to provide an apparatus for placing two or more folds in a sheet of paper which is less likely to jam and easier to clear if jammed than previous folding apparatus.

It is a further object of the present invention to provide an apparatus for placing two or more folds in a sheet of paper which requires only a single fold position controlling chamber and one pair of fold producing rollers.

To achieve the foregoing and other objects, and to overcome the shortcomings discussed above, a sheet folding apparatus is disclosed which includes an inlet for receiving a sheet material from outside of the sheet folding apparatus, an outlet for discharging the sheet material to outside of the sheet folding apparatus, and a folding mechanism within the apparatus for placing one or more folds in the sheet material. The folding mechanism includes a fold position controlling chamber having first and second ends and including at least one fold plate stop spaced from said first end for blocking the fold position controlling chamber, first and second fold producing rollers contacting each other at peripheral surfaces thereof and located adjacent the first end of the fold position controlling chamber for withdrawing a sheet from the fold position controlling chamber and placing a fold therein and a recirculation passage extending around the periphery of one of the first and second fold producing rollers so that a sheet can be conveyed around the outer periphery thereof and be inserted back into the fold position controlling chamber after being withdrawn from the fold position controlling chamber by the first and second fold producing rollers. The once-folded sheet can then be directed to the outlet or back through the first and second fold producing rollers to place a second fold therein.

This structure permits one or more folds to be placed in sheet material while requiring only a single fold position controlling chamber and one pair of fold producing rollers. By placing a plurality of fold plate stops at various locations along the length of the fold position controlling chamber, the number and locations of the folds for a variety of sheet sizes can be precisely controlled. The present invention can be used to place Z-folds and letter-folds in a sheet. Additionally, by locating the outlet at the second end of the fold position controlling chamber so that folded sheets can be outputted from the sheet folding apparatus by passing them through the fold position controlling chamber without being blocked by any fold plate stops, a particularly compact design can be provided.

BRIEF DESCRIPTION OF THE DRAWINGS

The invention will be described in detail with reference to the following drawings in which like reference numerals refer to like elements and wherein:

FIG. 9 is a side view of a second embodiment of the present invention;

FIGS. 10A–B illustrate the way in which a sheet will be folded when passed through the embodiment of FIG. 9 and a mirror image of the embodiment of FIG. 9, respectively;

FIGS. 11A–H illustrate the movement of a sheet through the embodiment of FIG. 9 to place a Z-fold in the sheet;

FIG. 112 is a side view of a third embodiment of the present invention;

FIGS. 13A–B illustrate how a sheet is folded when passed through the embodiment of FIG. 12 and a mirror image of the FIG. 12 embodiment, respectively;

FIGS. 14A–H illustrate the movement of a sheet through the embodiment of FIG. 12 to place a Z-fold in the sheet;

FIG. 15 is a side view of a fourth embodiment of the present invention;

FIGS. 16A–B illustrate how a sheet is folded when passed through the embodiment of FIG. 15 and a mirror image of the FIG. 15 embodiment, respectively;

FIGS. 17A-H illustrate the movement of a sheet through the embodiment of FIG. 15 to place a Z-fold in the sheet.

DETAILED DESCRIPTION OF THE PREFERRED EMBODIMENTS

Figure 1A:
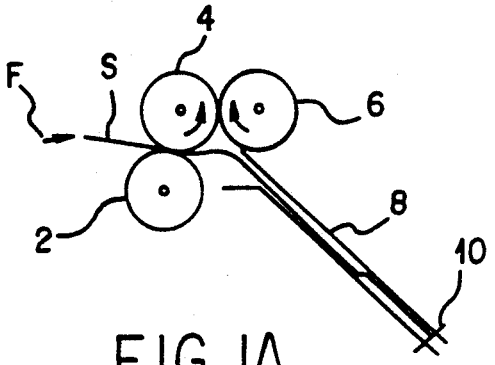
FIG. 1A is a side view of a buckle folder which uses a single fold chamber and a pair of fold rollers to place a fold in a sheet.
Figure 1B:
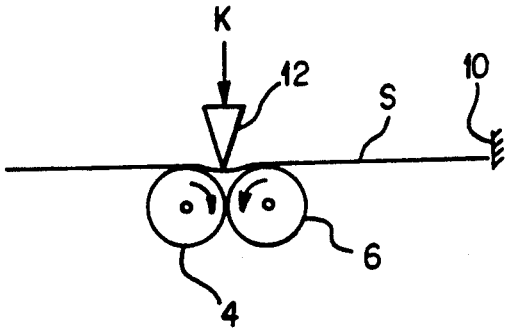
FIG. 1B is a side view of a knife folder which uses a knife to force a sheet between a pair of fold producing rollers.
Figure 2A:
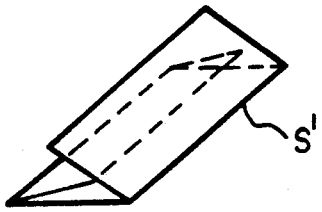
FIG. 2A is an isometric view of a sheet folded into a letter-fold.
Figure 2B:
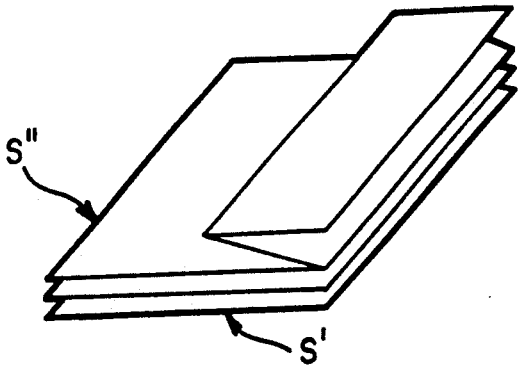
FIG. 2B is an isometric view of a stack of sheets wherein the upper sheet is folded into a Z-fold.
Figure 7:
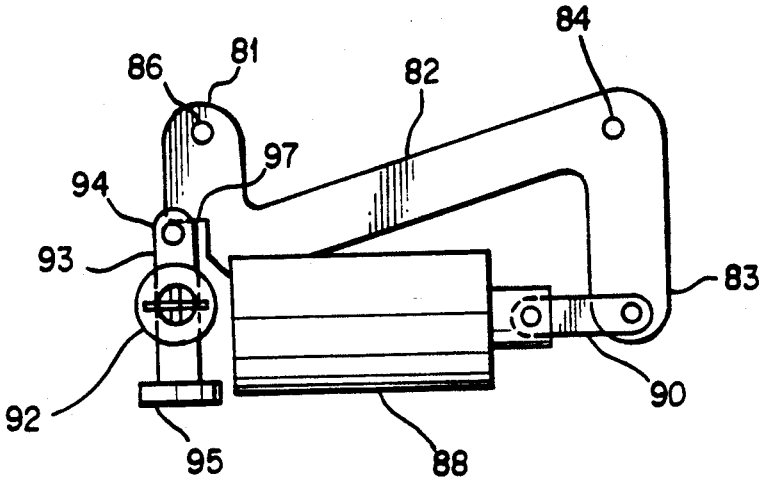
FIG. 7 is a side view of a dual-solenoid mechanism for moving the control gate of the embodiment of FIG. 4 through its three positions.
Figure 3:
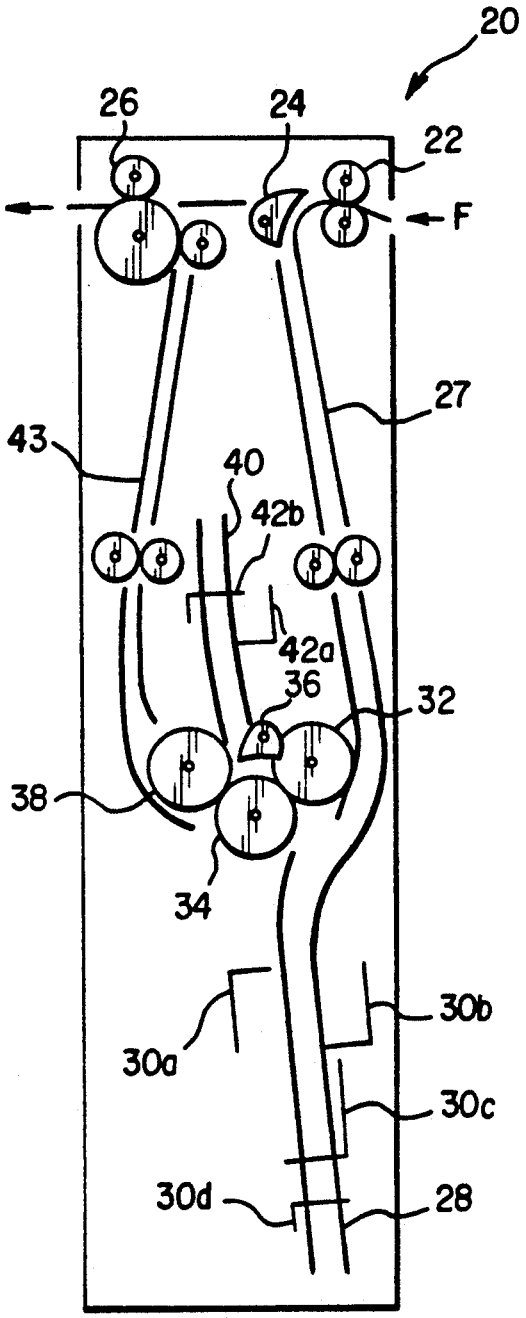
FIG. 3 PRIOR ART
FIG. 3 is a side view of a prior art folding apparatus for placing Z-folds in a sheet of paper.
Figure 4:
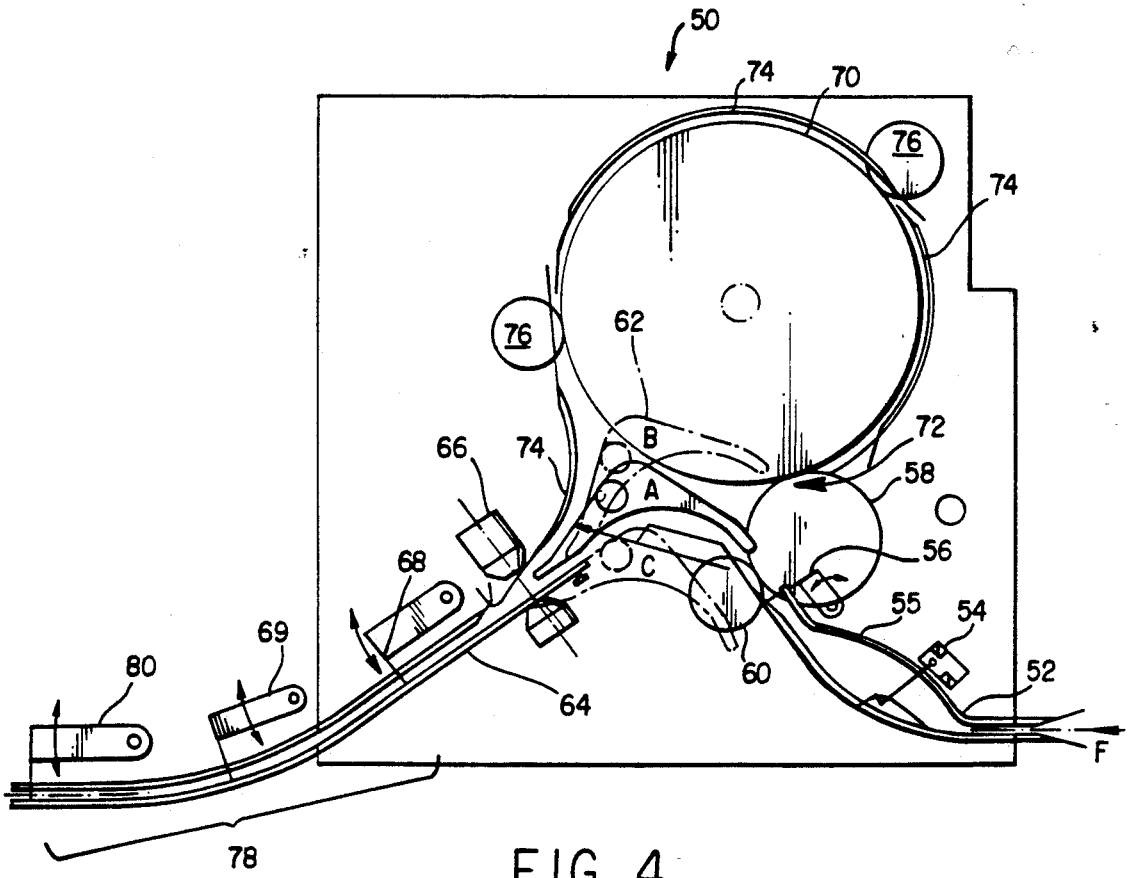
FIG. 4 is a side view of a first embodiment of the present invention and illustrates three positions of a control gate used with this embodiment.
Figure 5A:
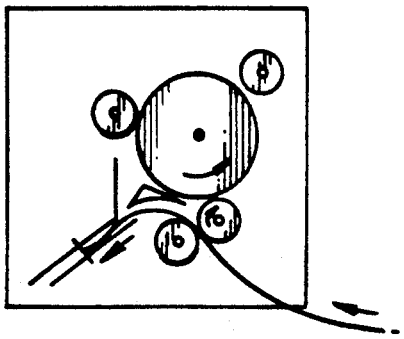
FIGS. 5A–H illustrate the movement of a sheet through the embodiment of FIG. 4 to place a Z-fold in the sheet.
Figure 5B:
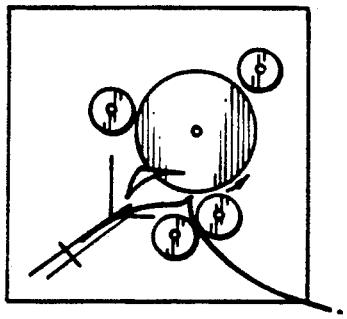
Figure 5C:
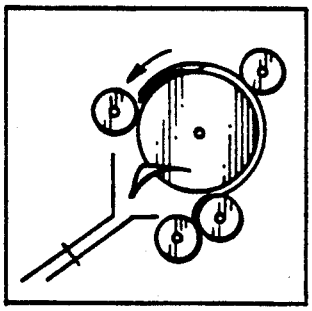
Figure 5D:
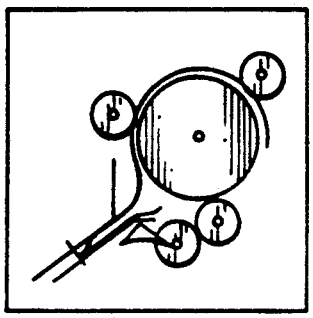
Figure 5E:
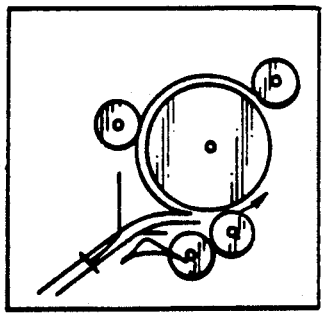
Figure 5F:
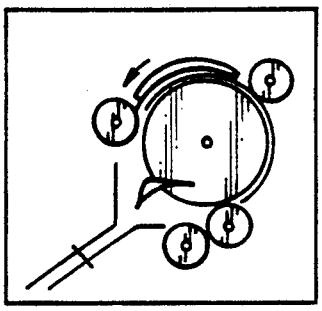
Figure 5G:
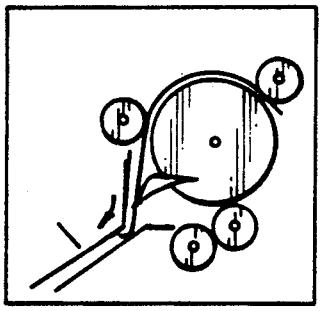
Figure 5H:
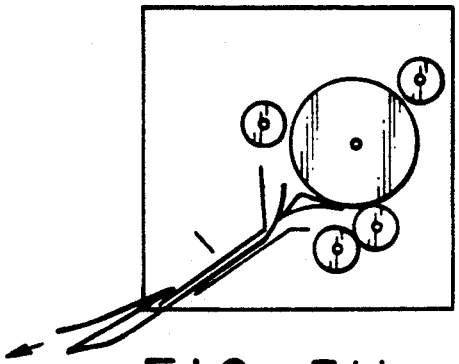
Figure 6A:
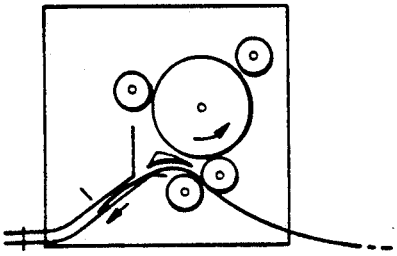
FIGS. 6A–E illustrate the movement of a sheet through the embodiment of FIG. 4 to place a half-fold in the sheet.
Figure 6B:
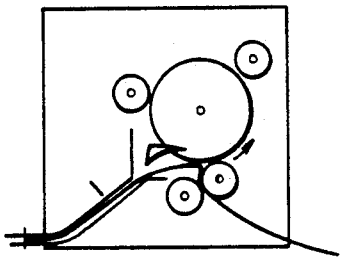
Figure 6C:
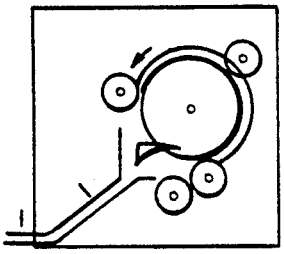
Figure 6D:
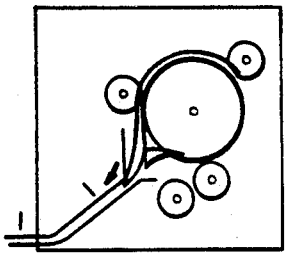
Figure 6E:
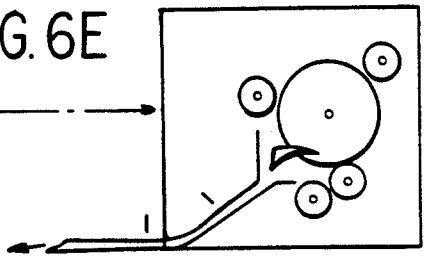

FIG. 4 is a side view of a first embodiment of a sheet folding apparatus 50 according to the present invention. Sheet folding apparatus 50 includes an inlet 52 which receives a sheet being fed in feed direction F. A sheet can be fed to folding apparatus 50 from, for example, a copier or a printer. The sheet enters first passage 55 and contacts a moving gate buckle registration system 56 which deskews the sheets as they enter the folder. A switch 54 is used to time the actuation of gate 56. When stop gate 56 is moved out of first passage 55, the sheet will be engaged between rollers 58 and 60 and deflected into fold position controlling chamber 64 by control gate 62. Control gate 62 can be moved in a controlled manner between positions A, B and C as described below. Initially, control gate 62 is in position A so that the sheet is directed into fold position controlling chamber 64. When placing Z-folds in sheets, a fold plate stop 68 is positioned in chamber 64 to block the passage of the sheet therethrough. Once the lead edge of the sheet is blocked by fold plate stop 68 and control gate 62 is moved to position B, a buckle will form in the sheet and eventually be captured in the nip 72 between first and second fold producing rollers 58,70 which then place a fold in the sheet as well as withdraw the sheet from the fold position controlling chamber 64. A sensor 66 is provided in fold position controlling chamber 64 and detects the movement of the sheet into fold position controlling chamber 64 to signal a controller, to be described below, that control gate 62 should be moved to position B. Once folded and withdrawn from fold position controlling chamber 64, the sheet is conveyed along a recirculation passage which extends around the periphery of one of the fold producing rollers 70. The recirculation passage is defined by a plurality of plates 74 and also includes one or more follower rollers 76 that contact fold producing roller 70 to convey the sheet around roller 70. After being conveyed around roller 70 once, the sheet is directed back into fold position controlling chamber 64 by contacting control gate 62 while in position B. After the sheet is sensed by sensor 66, control gate 62 is moved entirely out of the sheet conveying passages to position C. A second buckle is then formed in the sheet, which buckle is captured in nip 72 formed between first and second fold producing rollers 58,70 to place a second fold in the sheet while withdrawing it from fold position controlling chamber 64. Control gate 62 is then returned to position A and the sheet, after being conveyed around fold producing roller 70, is directed back into the fold position controlling chamber 64.

Once the desired number of folds (usually two) are formed in the sheet, fold plate stop 68 is moved out of chamber 64 to open this chamber and allow the sheet to exit folding apparatus 50. An extension 78 can be added to fold position controlling chamber 64 and an additional fold plate stop 80 can be added so that a sheet can optionally be folded in half by sheet folding apparatus 50. Obviously, when sheets exit sheet folding apparatus 50 which includes the half fold option, both fold plate stops 68 and 80 must be moved out of chamber 64 and extension 78.

FIGS. 5A-H illustrate the movement of a sheet through sheet folding apparatus 50 to place a Z-fold in the sheet. These figures also illustrate the location of control gate 62 and fold plate stop 68 during the folding process. FIGS. 6A-E illustrate the movement of a sheet through sheet folding apparatus 50 utilizing extension 78 and second fold plate stop 80 to form a half-fold in a sheet. As can be seen from FIG. 5A-H and 6A-E, the sheet enters fold position controlling chamber 64 from a first direction when entering from the inlet and from a second direction, different from the first direction, when entering from the recirculation passage. Control gate 62 is required in order to ensure that the sheet properly enters chamber 64 regardless of its direction of entry.

The embodiment illustrated in FIG. 4 can also be used to form letter-folds in sheets of paper by providing an additional fold plate stop 69. The position of this stop will depend on the size of sheet to be folded. As a sheet is initially directed into fold position controlling chamber 64 from first passage 55, stop 68 would be moved out of chamber 64 and stop 69 would be moved into and thus block passage of the sheet through chamber 64. A first fold would then be formed in the sheet as described above except that this fold would be produced closer to the trailing end of the sheet than when a Z-fold is produced. After being directed around the recirculation passage, the sheet is directed back into chamber 64 except an appropriately positioned fold plate stop is now located in chamber 64 to block passage of the sheet therethrough. A second fold is then placed in the sheet as described above, except, due to the use of fold plate stop 69 in forming the first fold, the resulting twice-folded sheet will be in the form of a letter-fold.

Instead of exiting from fold position controlling chamber 64, an outlet can be provided along the recirculation passage. A movable outlet deflector gate would be located between the outlet and the recirculation passage and would be selectively movable into the recirculation passage to deflect the folded sheet to the outlet. The provision of an outlet in the recirculation passage will be described in more detail below with reference to other embodiments. It is also understood that a sheet can be passed through folding device 50 without being folded simply by moving all of the fold plate stops, 68,69 and 80 out of chamber 64.

Figure 8A:
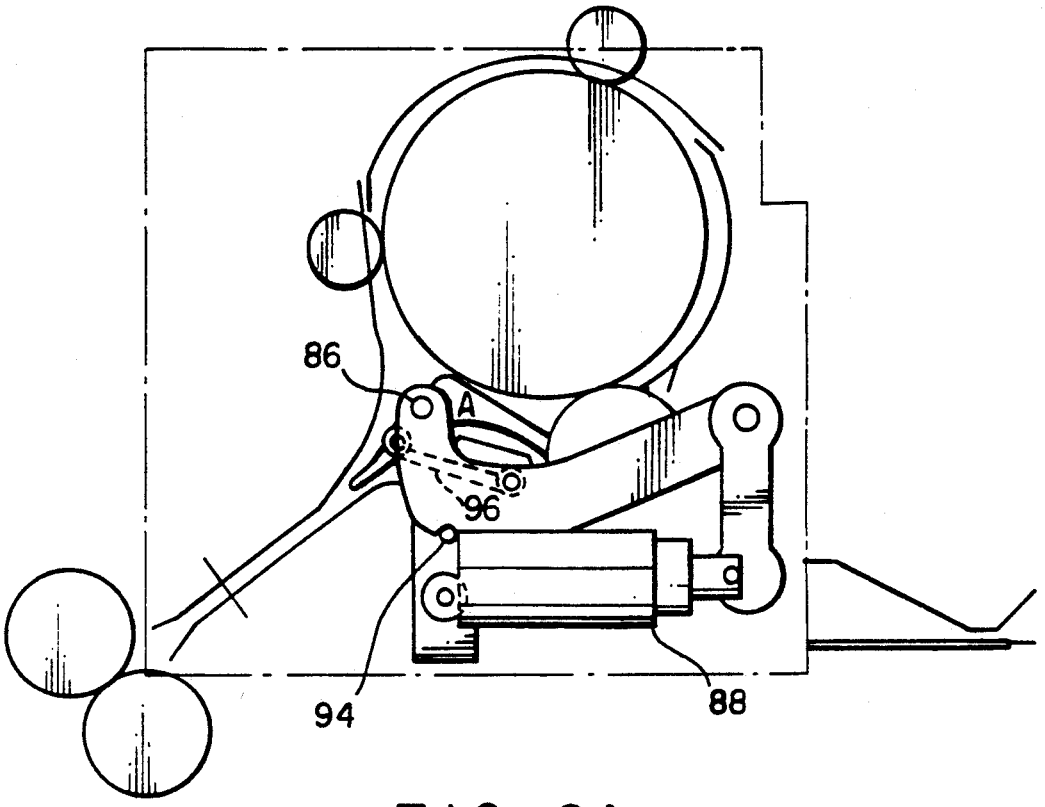
FIGS. 8A–C are side views of the embodiment of FIG. 4 and illustrate how the mechanism of FIG. 7 moves the control gate through its three positions.
Figure 8B:
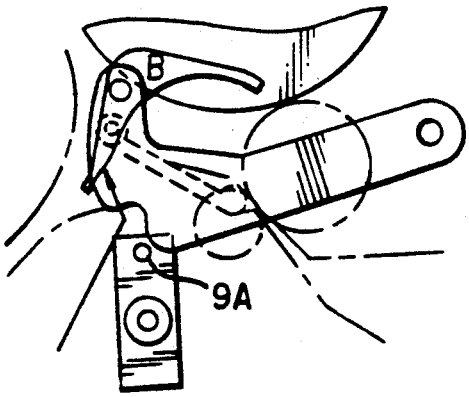
Figure 8C:
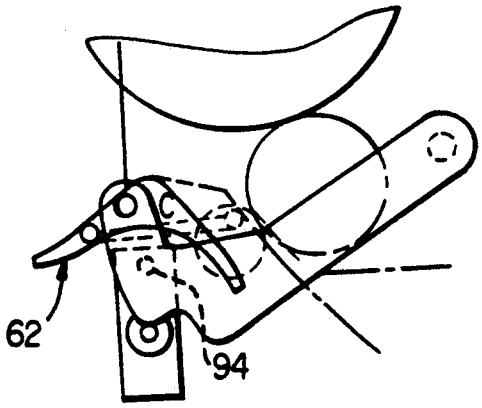

FIGS. 7 and 8A-C illustrate the mechanism for moving the three position control gate 62 which is used to guide sheets into the fold position controlling chamber 64 from two different directions. The mechanism includes a first linkage 82 which is pivotally attached at first end 81 to control gate 62 at pivot point 86 and a second linkage 96 which is also pivotally attached to control gate 62 at one end and pivotally attached to a frame member at another end. Linkage 82 is pivotally mounted in apparatus 50 at pivot point 84. The linkage 82 is attached to drive solenoid 88 through link 90 at a second end 83 thereof. A small solenoid 92 includes a pin 94 which acts as a stop for linkage 82, by contacting surface 97 thereof, to provide the three positions A, B and C of control gate 62. Pin 94 is attached to one end of a pivot arm 93 which is attached to an actuator arm of solenoid 92 and is pivotally mounted to a supporting surface 95 at an end thereof opposite from the pin 94. Pivot arm 93 thus supports the weight of linkage 82 and allows the full life expectancy to be realized from solenoid 92 as opposed to an arrangement where the actuator arm of solenoid 92 directly engages surface 97 of linkage 82 which results in solenoid 92 supporting the weight of linkage 82. When solenoid 88 is activated, linkage 82 is pivoted about pivot point 84 to move control gate 62 to position B as shown in FIG. 8B. When drive solenoid 88 is deactivated, and if small solenoid 92 is activated to move pin 94 out of the path of linkage 82, linkage 82 will pivot about pivot point 84 to move control gate 62 to position C as shown in FIG. 8C. However, if solenoid 92 is not activated and pin 94 extends into the path of linkage 82, linkage 82 will move until blocked by pin 94 and place control gate 62 at its central position A as illustrated in FIG. 8A.

FIG. 9 is a side view of a second embodiment of a sheet folding apparatus 100 according to the present invention. Sheet folding apparatus 100 includes an inlet 152 which receives a sheet being fed in the feed direction S. The embodiment illustrated in FIG. 9 is similar to the FIG. 4 embodiment except that the sheet is fed to the fold position controlling chamber 164 from the same direction when moved from the inlet 152 and from the recirculation passage provided around fold producing roller 170. An advantage of this embodiment is that no control gate is required since the sheet always enters fold position controlling chamber 164 from the same direction. A plurality of fold plate stops 168*a–d* and 180 are provided in fold position controlling chamber 164 to locate a fold at a variety of locations on sheets having a variety of sizes.

In order to form a Z-fold the second embodiment operates as follows. A sheet enters inlet 152 and is conveyed through first passage 155 to rollers 160 and 170. First passage 155 can include a moving gate buckle registration system and a stop gate as in the first embodiment. The sheet is then conveyed by rollers 160 and 170 into the fold position controlling chamber 164 until it contacts, for example, fold plate stop 180. A buckle then forms in the sheet which is captured in the nip formed between first and second fold producing rollers 158, 170. Fold producing rollers 158, 170 place a first fold in the sheet while withdrawing the sheet from fold position controlling chamber 164. The sheet then passes through the recirculation passage which is defined by plate(s) 174 and follower roller 176 and is reinserted into fold position controlling chamber 164. A second fold is then placed in the sheet as described above. The sheet exits folding apparatus 100 one of two ways. If the outlet passage is located on the end of fold position controlling chamber 164 opposite from the end adjacent fold producing rollers 158,170, the sheet is conveyed entirely around the recirculation passage and back into the fold position controlling chamber 164. However, after placing the desired number of folds in the sheet, all of the fold plate stops 168*a–d* and 180 are moved to the open position so that the folded sheet passes entirely through chamber 164 to the outlet. Alternatively, an outlet can be provided which is in communication with the recirculation passage. For example, a movable outlet deflector gate 190 can be provided which, when moved into the recirculation passage, deflects the sheet out of the recirculation passage to output rollers 192. Output rollers 192 then conveys the sheet through outlet passage 194 to, for example, an output tray.

FIG. 10A illustrates the input and output orientations of a sheet which is Z-folded by the apparatus according to FIG. 9. FIG. 10B illustrates the input and output orientations of a sheet folded by an apparatus which is constructed as a mirror image of the FIG. 9 embodiment. Thus, the output shown in FIG. 10A would result when the device of the present invention is used with a printer or copier which outputs documents from its left side, whereas the FIG. 10B output would result with a right side outputting printer or copier. FIG. 11A–H illustrates the movement of a sheet S through the embodiment of FIG. 9 to place a Z-fold in the sheet.

FIG. 12 is a side view of a third embodiment of a sheet folding apparatus 200 according to the present invention. The embodiment of FIG. 12 operates in a manner similar to that of the FIG. 9 embodiment, except that it is more compact and capable of inputting and outputting sheets from different directions than the FIG. 9 embodiment. A sheet enters input 252 and, after passing through first passage 255 is directed into fold position controlling chamber 264 by rollers 260,270. The sheet is stopped by, for example, fold plate stop 280 and a buckle is formed and captured in the nip defined between first and second fold producing rollers 258,270. The sheet is folded and withdrawn from chamber 264 by fold producing rollers 258,270 and conveyed through the recirculation passage defined around the outer periphery of fold producing roller 270 with the assistance of follower roller 276. The once-folded sheet is inserted into chamber 264 from the recirculation passage in the same direction as when inserted from first passage 255 and is stopped by, for example, fold plate stop 268. The sheet is folded a second time as described above and exits folding apparatus 200 either through outlet passage 294 (through the actuation of a movable outlet deflector gate described above) or through the end of fold position controlling chamber 264 opposite from the end adjacent fold producing rollers 258,270. FIGS. 13A and 13B are similar to FIGS. 10A and 10B and illustrate the input and output orientations of a sheet which is conveyed through the FIG. 12 device and a mirror image thereof, respectively. FIGS. 14A–H illustrate the positions of a sheet as it is conveyed through folding apparatus 200 to place a Z-fold therein.

FIG. 15 is a side view of a fourth embodiment of a sheet folding apparatus 300 according to the present invention. An advantage of the FIG. 15 embodiment is that a sheet can be passed therethrough without being folded quickly and easily by providing outlet 394 and movable outlet deflector gate 390. After entering inlet 352, a sheet passes through first passage 355 and between rollers 360 and 370. If the sheet is not to be folded, movable outlet deflector gate 390 is moved into the passage (which is the recirculation passage) around roller 370 to deflect the sheet into outlet passage 394. If the sheet is to be folded, deflector gate 390 is moved to block outlet passage 394 and permit the movement of the sheet around the outer periphery of roller 370 and between rollers 370,376 to be inserted into fold position controlling chamber 364. The sheet is stopped by fold plate stop 380 and a buckle is formed therein and captured by the nip defined between first and second fold producing rollers 358,370. The sheet is folded and withdrawn from fold position controlling chamber 364 as described above. After recirculating around roller 370, the sheet is reinserted into chamber 364 and is stopped by fold plate stop 368. A second fold is placed in the sheet and it is then outputted from folding apparatus 300 through either outlet passage 394 or the end of fold position controlling chamber 364 which is opposite from the end adjacent the first and second fold producing rollers 358,370. The sheet exits along one of the paths indicated by arrows E. As described above, the fourth embodiment can include an additional fold plate stop for placing half-folds in sheets. It is understood that a sheet can be outputted through either of the outlets at any time (i.e., before or after being once or twice folded). FIGS. 16A and 16B illustrate input and output orientations of a sheet which is passed through the FIG. 15 embodiment or a mirror image thereof to produce a Z-fold therein. FIGS. 17A–H illustrate the positions of a sheet as it is passed through the FIG. 15 embodiment to place a Z-fold therein.

EXAMPLE

Figure 18:
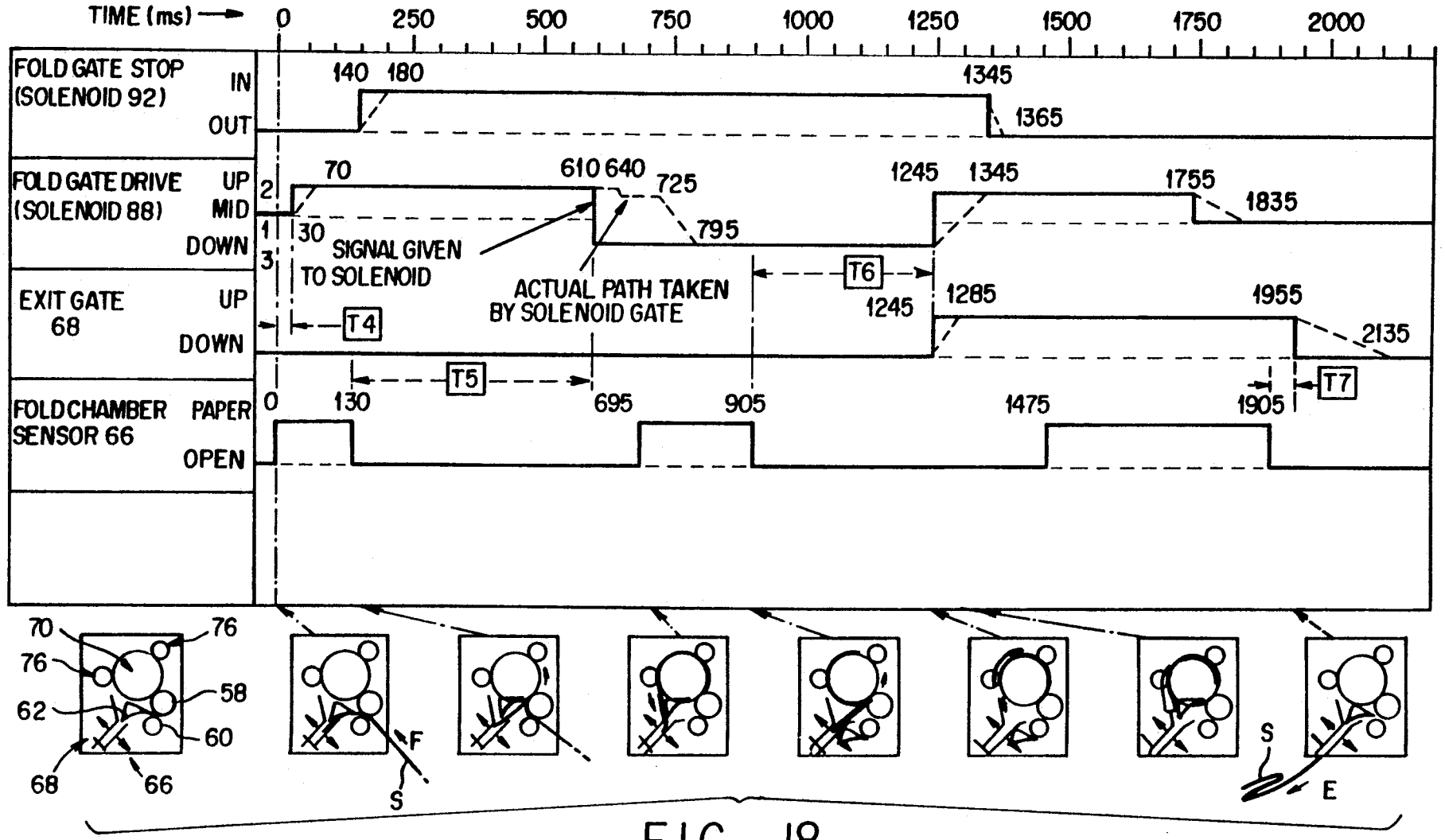
FIG. 18 is a timing diagram illustrating the actuation of the control gate and exit gate of the embodiment of FIG. 4.

A sheet folding apparatus according to the embodiment illustrated in FIG. 4 (that is, the embodiment including the three position control gate 62) was built and controlled as described below. During a Z-folding cycle, the three-position gate 62 must undergo three movements and the fold/exit gate (e.g., gate 68 if it is the only gate in chamber 64) must be actuated once. The timing for these movements was studied and optimized to give the maximum possible latitude. Solenoid response times were measured and folder operation over a large tolerance of control gate spring forces was verified. Although most testing was done with the folder operating at a paper speed of 500 mm/second, the discussion below describes the necessary changes required to run at any paper velocity. FIG. 18 illustrates the nominal timing parameters used when the Z-folder is run at 500 mm/s. The location of a 17 inch sheet within the folder is shown during various stages of the cycle for reference. The folding apparatus was constructed according to the following parameters: the distance from sensor 66 to fold/exit gate 68 was 20 mm; the diameter of first fold producing roller 58 was 35 mm; the diameter of second fold producing roller 70 was 89.2 mm; and the distance along the recirculation path between rollers 58 and 76 was 200 mm. Fold producing roller 58 was made from EPDM (ethylene-propylene-diene random copolymer) having a Shore A hardness of 63 and was spring loaded against roller 70 with a total force of 27 ± 4.5 lbs. although the force can be within the range between about 20 and 44 lbs. Fold producing roller 70 had a surface made from MCPU (Micro Cellular Polyurethane or Mearthane) having a Shore A hardness of 46. The follower rollers 60 and 76 were standard Delrin rollers. The three movements of the control gate 62, and the actuation of the fold gate stop 68 are referenced from four transitions of the fold plate sensor 66 and have been denoted as T4, T5, T6, and T7. These four timing parameters will be discussed individually.

T4

This time determines when the three-position gate 62 moves from its center position A, where it guides the leading edge of the sheet into the fold position controlling chamber 64, to its upper position B. When the gate 62 is in upper position B, the sheet has room to extend into the buckle chamber and be drawn into the fold nip 72. If the gate is actuated too late, the paper may begin to buckle within the chamber 64, potentially causing a jam or paper damage. The time required for the paper to move the 20 mm distance from the sensor 66 to the fold plate stop 68 is simply, $$t = 20\ \text{mm}/V_{paper}.$$

For a paper velocity of 500 mm/s, this yields 40 ms. The nominal gate actuation time (i.e., stroke time from center to upper position) was determined to be 40 ms, however a tolerance of plus or minus 20 ms was assumed to insure reliable operation in maximum latitude. The acceptable range of actuation times was determined empirically. T4 was varied from 12 to 70 ms with no degradation in folder performance. From this, a nominal T4 of 30 ms was chosen. A general equation for determining the nominal value of T4 at different paper speeds (assuming a gate actuation time of less than 60 ms) can then be expressed as:

$$T_4 = (D_{sensor\text{-}foldgate(mm)}/V_{paper(mm/s)}) - 0.01\ \text{sec.}$$

This time determines when the drive solenoid 88 for the three-position control gate 62 is released. This occurs just prior to the formation of the second fold. In order to minimize the size of the large fold roll 70, and the folder cycle time, a paper path length was chosen that results in the trail edge of a folded sheet leaving the area below control gate 62 just before its lead edge contacts the fold plate stop 68. The geometry is utilize to time the downward motion of control gate 62 by releasing the gate onto the trail edge of the sheet as it exits fold position control chamber 64. The gate 62 then drops when the trail edge passes the gate. If it is not desired to contact the trail edge of the sheet with control gate 62, it would be a simple design change to increase the large fold roll 70 diameter slightly and to electronically release the gate at the appropriate time.

By using the trail edge of the sheet to trigger the motion of the control gate 62 (i.e., when sensor 66 detects the trailing edge of the sheet exiting fold position controlling chamber 64), a very consistent release time is seen. This makes the release time of the solenoid 88 less critical. As shown in FIG. 18, the solenoid 88 is electronically released 480 ms after the sheet leaves the fold chamber sensor 66. The gate 62 drops against the trail edge of the sheet 30 ms later and remains there for 85 ms before the trail edge releases gate 62. A value of T5 for use at other paper speeds can be calculated from:

$$T_5 = (240/V_{Paper(mm/s)})\ \text{sec.}$$

The only disadvantage of using the above system is that the gate drop time is slightly different for 11 × 17 inch paper and A3 (16.54 inches long) sheets. This results in the lead edge of A3 paper being 5.8 mm farther from the fold plate stop 68 than the lead edge of 17 inch paper when the gate 62 drops. Testing showed this small difference to have no effect on folder performance.

More important than the electrical release time of the solenoid 88 is the time required for the gate 62 to drop once it is released. The above-described gate system ad a rotational inertia I of approximately 0.0017 kg−n2 and the return spring of solenoid 88 provided a total return torque T (including the weight of the gate) of 0.3N−n. This yields a theoretical return stroke time of:

$$t = \sqrt{\frac{2 \times \theta \times I}{T}} = \sqrt{\frac{2 \times .314 \times .0017}{.03}} = .060\ \text{sec.}$$

wherein $\theta$ is the angle through which the control gate swings from position B to position C. The actual return stroke time was measured to be 70 ms as shown in FIG.

18. Empirical studies yielded the following guidelines for maximum allowable gate release/stroke times:

Gate motion must begin within a time of $(8/V_{paper(mm/s)})$ sec. after the leading edge of the sheet contacts the fold plate stop 68. (This is automatically ensured when using the trailing edge to release the gate as explained above.)

Once motion begins, the total stroke time should be less than $(50/V_{paper(mm/s)})$ sec. to ensure the control gate 62 clears the buckle chamber. (At a paper velocity of 500 mm/s, this yields a maximum allowable stroke time of 100 ms.)

T6

This timing constant determines when the three-position control gate 62 is brought from its lowest position C (where it resided during the second fold) to its uppermost position B (where it acts to guide the sheet back into fold chamber 64). This time must be calculated so as to ensure that the trailing edge of the "Z" folded sheet has cleared the fold chamber before the gate 62 reaches its upper position. If actuated too soon, the gate can damage the trailing edge of the sheet. As shown below, the time elapsed between the moment the sheet unblocks the fold chamber sensor 66 to the time the trailing edge clears the path of the gate 62 is:

$$t_{clear} = \left( \frac{D_{sensor\text{-}fold\ nip} - D_{gate\ path\text{-}fold\ nip} + (L_{sheet}/4)}{V_{paper}} \right)$$

For the present system this yields: $t_{clear}$=[88 mm−5 mm+ (17″/4) (25.4 mm/in)]/500 mm/s=0.382 sec. From the above analysis it is seen that gate 62 must not cross the paper path less than $t_{clear}$ seconds after the sheet clears the fold chamber sensor 66. Note that 17″ paper will be a worse case condition since A3 is shorter and will clear the control gate 62 sooner. The solenoid/gate actuation time (from lower to upper gate position) was measured to be 100 ms, and the gate was observed to cross the paper path after a period of 90 ms. If a tolerance on this value of ±30 ms is assumed, then the earliest solenoid actuation time for this system is:

$$\begin{aligned} T6_{min} &= t_{clear} - t_{gate\ actuation\ time\ (min)} \\ &= 382\ \text{ms} - (90 - 30)\ \text{ms} \\ &= 322\ \text{ms} \end{aligned}$$

From the time the trail edge of a "Z" folded 17″ sheet leaves the fold chamber sensor 66 to the time its lead edge reenters the fold chamber 64, the sheet must travel a distance of approximately 230 mm. At 500 mm/s, this distance will be traveled in a time of 460 ms. Taking the worst case gate actuation time to be 90+30=120 ms, then we find:

$$T6_{max}=460\ \text{ms}-120\ \text{ms}=340\ \text{ms}.$$

The theoretical $T6_{min}$ calculated above was verified empirically by reducing T6 until trail edge damage occurred. With a nominal 90 ms gate actuation time, T6 was reduced to 280 ms before damage was seen. Empirical testing to verify $T6_{max}$ showed there to be considerably more latitude than the theoretical calculations indicated. T6 was increased up to 560 ms before failure occurred, indicating that the sheet was able to reenter the fold chamber without the assistance of the 3-position gate. However, since this test was not performed using stress case up-curl, it is still recommended that the theoretical maximum for T6 be used. A general equation for the recommended nominal value of T6 (assuming a gate actuation time of 90 + 30 ms) is then:

$$T6=(230\ \text{mm}/V_{paper(mm/s)})-t_{gate\ actuation\ time(max)}$$

Lastly, it should be pointed out that T6 also determines when the fold chamber exit gate is raised and when the fold chamber stop is released. The fold gate stop should not be released before the gate is actuated (to minimize drag on the gate), but other than that these actions can tolerate large timing variations with no effect on folder performance.

T7

This time determines when the exit gate can be dropped back into position in preparation for the next sheet to enter the fold chamber. After the trail edge of a completed "Z" folded sheet leaves the fold chamber sensor 66, it will clear the fold chamber area in a time of $t=d_{fold\ chamber-sensor}/V_{paper}$. Adding in a small safety margin yields a general equation for T7 of:

$$T7=(d_{fold\ chamber-sensor}/V_{paper})+0.01\ \text{sec.}$$

Half Folding Requirements:

For half folding, the three position control gate 62 only has to move twice (between the center and uppermost positions). The only critical movement is the first movement and will occur at a time equal to T4 (from "Z" folding mode) plus the time it takes the sheet to travel from the "Z" fold plate stop 68 to the half fold plate stop $80=(d_{\text{"}Z\text{"}-half\ fold\ plate\ stops}/V_{paper})$.

Thus, a device which is capable of place Z-folds, letter-folds and half folds in a sheet which requires only a single fold position controlling chamber and one pair of fold producing rollers is provided. The folder of the present invention requires less space and is less costly than previous Z-folders. The present invention has a small number of parts and is less susceptible to paper jams. Since all folds are produced in the same nip, they will be consistent with one another.

The present invention can be located downstream of existing printer or copier systems and can be incorporated into existing systems where documents are folded and placed into envelopes which are then sealed and outputted "ready-to-mail".

While the present invention is described with reference to Z-folders, this particular embodiment is intended to be illustrative, not limiting. For example, the present invention can also be used to place half-folds and letter-type folds in sheets. It is also understood that recirculation of sheets could also be accomplished using baffles and drive rollers which are separate from the fold rollers. Various modifications may be made without departing from the spirit and scope of the invention as defined in the appended claims.

What is claimed is:

1. A device for forming one or more folds in a sheet, comprising:

a chamber for receiving a sheet to be folded;

at least one gate located in said chamber for blocking passage of the sheet through said chamber, said at least one gate being movable into and out of said chamber for alternately blocking said chamber and opening said chamber;

a pair of fold producing rollers for placing a fold in the sheet while withdrawing the sheet from said chamber; and recirculating means for recirculating the once-folded sheet back into said chamber so that said pair of fold producing rollers can place a further fold in the sheet.

2. The device according to claim 1, further including gating means, attached to said gate, for moving said gate into and out of said chamber.

3. The device according to claim 2, wherein said gating means is a solenoid.

4. The device according to claim 1, further comprising an outlet for discharging sheets from said device, said outlet being attached to said chamber downstream of said at least one gate relative to a sheet feeding direction.

5. The device according to claim 1, wherein said chamber includes a plurality of gates spaced along said chamber, each gate being selectively movable into and out of said chamber for blocking and opening a portion of said chamber, and gating means for selectively moving said plurality of gates into and out of said chamber based on the size of the sheet and placement of the fold in the sheet.

6. The device according to claim 5, further comprising an outlet for discharging sheets from said device, said outlet being attached to said chamber downstream of said plurality of gates relative to a sheet feeding direction.

7. A device for forming one or more folds in a sheet, comprising:

receiving means for receiving a sheet to be folded;

a pair of old producing rollers for placing a fold in the sheet while withdrawing the sheet from said receiving means; and recirculating means for recirculating the once-folded sheet back into said receiving means so that said pair of fold producing rollers can place a further fold in the sheet, wherein said recirculating means is a recirculation passage extending around a portion of a circumference of one of said fold producing rollers, and at least one follower roller extending into said passage and contacting said one fold producing roller so that a sheet is conveyed around said passage by rotation of said one fold producing roller.

8. The device according to claim 7, further comprising an outlet for discharging sheets form said device, said outlet being in communication with said recirculation passage, and an outlet gate located between said outlet and said recirculation passage, said outlet gate being movable between a first position where it blocks access to said outlet form said recirculation passage and a second position where it extends into said recirculation passage to direct sheets to said outlet.

9. A sheet folding apparatus for placing at least two folds in a sheet, comprising:

an inlet for receiving a sheet material from outside of the sheet folding apparatus;

an outlet for discharging the sheet material to outside of the sheet folding apparatus;

a single fold position controlling chamber having first and second ends and including at least one fold gate spaced from said first end for blocking the passage of a sheet through said fold position controlling chamber;

a first passage extending between said inlet and the first end of said fold position controlling chamber;

first and second fold producing rollers contacting each other at peripheral surfaces thereof and located adjacent tot he first end of said fold position controlling chamber for withdrawing a sheet from said fold position controlling chamber and placing a fold therein;

a recirculation passage extending around a periphery of one of said first and second fold producing rollers so that a sheet can be conveyed around the outer periphery thereof and inserted back into said fold position controlling chamber after being withdrawn form said fold position controlling chamber by said first and second fold producing rollers so that all folds placed in the sheet are formed by insertion of the sheet into said single fold position controlling chamber and removal of said sheet from said fold position controlling chamber by said first and second fold producing rollers; and said outlet being in communication with one of said fold position controlling chamber and said recirculation passage.

10. The apparatus according to claim 9, further comprising:

a movable outlet deflector gate located between said outlet and one of said fold position controlling chamber and said recirculation passage for selectively blocking and opening communication between said outlet and one of said fold position controlling chamber and said recirculation passage; and a first gating means for moving said movable outlet deflector gate between said blocking and open positions.

11. The apparatus according to claim 10, wherein said outlet is in communication with said fold position controlling chamber and said movable outlet deflector gate also functions as one of said at least one fold gate when int he blocking position.

12. The apparatus according to claim 10, wherein said outlet is in communication with said recirculation passage and said movable outlet deflector gate is located between said outlet and said recirculation passage.

13. The apparatus according to claim 12, further comprising:

a bypass deflector located between said inlet and said fold position controlling chamber and being movable between a blocking position wherein it blocks the passage of sheets form said inlet to said fold position controlling chamber and an open position wherein the passage of sheets from said inlet to said fold position controlling chamber is not blocked; and deflector moving means for moving said bypass deflector to the blocking position, said apparatus being operable in a bypass mode wherein said deflector moving means moves said bypass deflector to said blocking position and said first gating means moves said movable outlet deflector gate to said open position so that sheets bypass said fold position controlling chamber and exit said outlet without being folded and a folding mode wherein said deflector moving means moves said bypass deflector to said open position and said first gating means moves said movable outlet deflector gate to said blocking position so that sheets enter said fold position controlling chamber to be folded.

14. The apparatus according to claim 9, wherein said inlet is arranged relative to said first and second fold producing rollers and said fold position controlling chamber so that a sheet enters said fold position controlling chamber from a first direction from said inlet and from a second direction, different from said first direction, from said recirculation.

15. The apparatus according to claim 9, wherein said inlet is arranged relative to said first and second fold producing rollers and said fold position controlling chamber so that a sheet enters said fold position controlling chamber from the same direction when said sheet is moved form said inlet as when said sheet is moved from said recirculation passage.

16. A sheet folding apparatus, comprising:

an inlet for receiving a sheet material from outside of the sheet folding apparatus;

an outlet for discharging the sheet material to outside of the sheet folding apparatus;

a fold position controlling chamber having first and second ends and including at least one fold gate spaced from said first end for blocking the passage of a sheet through said fold position controlling chamber;

a first passage extending between said inlet and the first end of said fold position controlling chamber;

first and second fold producing rollers contacting each other at peripheral surfaces thereof and located adjacent to the first end of said fold position controlling chamber for withdrawing a sheet from said fold position controlling chamber and placing a fold therein;

a recirculation passage extending around a periphery of one of said first and second fold producing rollers so that a sheet can be conveyed around the outer periphery thereof and inserted back into said fold position controlling chamber after being withdrawn from said fold position controlling chamber by said first and second fold producing rollers;

said outlet being in communication with one of said fold position controlling chamber and said recirculation passage; and a control gate located adjacent to said inlet, said fold position controlling chamber and said recirculation passage for selectively directing a sheet from said inlet into said fold position controlling chamber, from said fold position controlling chamber into a nip formed between said first and second fold producing rollers, and from said recirculation passage into said fold position controlling chamber.

17. The apparatus according to claim 16, wherein said control gate is movable between first, second and third positions, each of said positions corresponding to one of the selective directing functions of the control gate, and further comprising means for selectively moving said control gate to each of said first, second and third positions.

18. The apparatus according to claim 17, wherein said means for selectively moving said control gate includes a first solenoid, attached to said control gate through a linkage, for moving said control gate between said first and third positions when actuated and deactuated, respectively, and a second solenoid, extendable into a path of said linkage, for selectively blocking movement of said linkage between said first and third positions, to locate said control gate in said second position.

19. A device for forming at least two folds in a sheet, comprising:

a single fold position controlling chamber for receiving a sheet to be folded;

a single pair of fold producing rollers for placing a fold in the sheet while withdrawing the sheet from said single fold position controlling chamber; and recirculating means for recirculating the once-folded sheet back into said single fold position controlling chamber so that said single pair of fold producing rollers can place a further fold in the sheet, wherein all folds placed in the sheet are formed by insertion of the sheet into said single fold position controlling chamber and removal of said sheet from said fold position controlling chamber by said single pair of fold producing rollers.

* * * * *